109-36 SR

12/2/80 XR 4,236,463

United States Patent [19]

Westcott

[11] 4,236,463

[45] Dec. 2, 1980

[54] TAMPER PROOF CASE FOR THE PROTECTION OF SENSITIVE PAPERS

[76] Inventor: Randy L. Westcott, 6927D Roswell Rd., NW., Atlanta, Ga. 30328

[21] Appl. No.: 38,916

[22] Filed: May 14, 1979

[51] Int. Cl.[3] ..... E05G 3/00

[52] U.S. Cl. ..... 109/33; 109/36; 109/43; 109/44

[58] Field of Search ..... 109/33, 34, 36, 37, 109/44, 39, 41, 45

[56] References Cited

U.S. PATENT DOCUMENTS

| | | | |
|---|---|---|---|
| 1,097,587 | 5/1914 | Hammond | 109/42 |
| 1,262,012 | 4/1918 | Bull | 109/36 |
| 1,454,894 | 5/1923 | Johnson | 109/36 |
| 1,606,516 | 11/1926 | Daly | 109/25 |
| 2,038,625 | 4/1936 | Adler | 109/44 |
| 3,489,107 | 1/1970 | Uhrig | 109/36 |
| 3,650,226 | 3/1972 | Conroy | 109/25 |
| 3,697,668 | 10/1972 | Campbell | 109/36 |
| 3,732,830 | 5/1973 | Lindstedt | 109/36 |

*Primary Examiner*—Reinaldo Machado

*Attorney, Agent, or Firm*—Newton, Hopkins & Ormsby

[57] ABSTRACT

A carrying case, having a hinged lid, is provided with a handle and locks. Within the interior of the case and hingedly connected to the case is a liner, within which are stored sensitive papers. A thermite charge is within a removable boat in the liner and has igniters electrically connected, through a selectively positionable key operated switch, to a battery and through various switch members so that the igniters are triggered upon the occurrence of and one of various events. One switch member is on the handle and is depressed when carrying the case. Other switch members are closed upon tilting; still other switch members are closed if a knife is passed through the exterior of the container. Still other switches are closed in the event that a knife is inserted to prize open the case or the case is opened without being disarmed.

Upon the making of an electrical circuit, the igniters ignite the thermite charge to burn or char the papers, the gases escaping through an opening in the lid of the case.

18 Claims, 8 Drawing Figures

25
20
40
44
43
42
41
22
24
40
49
45
12
42
43
41
44
10
14

102
104
103
41
24
71
41
100
90
94
93
95
94
27
30
92
22
80
81
86
82
20
18
82
18
85
44
10
81
72
43
35
41
16
31
45
12
70
73
35
43
52
44
41
14

TAMPER PROOF CASE FOR THE PROTECTION OF SENSITIVE PAPERS

BACKGROUND OF THE INVENTION

1. Field of the Invention

This invention relates to a tamper proof case for the protection of sensitive papers, such as secret documents, and for their destruction under prescribed conditions, and is more particularly concerned with a portable carrying case which will burn the documents within the case when the case is compromised.

2. Description of the Prior Art

In the past, numerous devices have been devised for protecting confidential and secret papers. For example, U.S. Pat. No. 3,732,830, disclosed a method of arranging sheets in juxtaposition and providing shaped charges for destroying these sheets. U.S. Pat. No. 3,650,226 discloses a document destruct file in which oxidizing panels ignite, burn and destroy the contents of a file. U.S. Pat. No. 3,489,107 discloses a self-destructing package which will destroy itself with a lapse of time or upon being tampered with and contains an interior pyrotechnic charge.

U.S. Pat. No. 1,606,516 discloses a valise which sets off automatically an audible and visual signal when seized by illegal party. A suitable gas is automatically liberated to fill the interior of the valise and to discolor the materials contained therein.

U.S. Pat. No. 1,454,894 discloses a safety carrying case provided with a gas chamber from which a gas is released and a projectile is released to disable or injure a person.

U.S. Pat. No. 1,262,012 discloses an alarm system in a handbag, suitcase or other valuable which is carried from place to place.

U.S. Pat. No. 3,980,162 discloses a flame and heat resistant luggage case which is insulated on its interior.

The present invention has a novel arrangement for destroying the material within a container or closure upon the occurance of any one of several events which can be preselected according to the desires of the operator. Thermite is employed within the interior of the container in order to assure a high temperature sufficient to destroy papers which are contiguous thereto.

SUMMARY OF THE INVENTION

Briefly described, the present invention includes a brief case, attache case, closure or container having a body portion to which is hingedly secured a lid or top which, when closed, can be locked in the closed position. Insulation surrounds the interior of the body portion and lid and a wire screen grid is provided over the lid. The lid is also perforated so that gases may readily escape from the interior of the container.

A liner is hingedly secured along a hinge on the interior of the case, the liner being provided with insulating material along the inside thereof. A removable boat carries a pyrotechnic charge of thermite on the interior of the liner. The thermite is set off by electrical igniters which are connected, through a key operated selector switch and various switch means, to a battery. The switch means are actuatable upon a change in the physical condition of the closure. Among the various switch means are the electrically conducting inner and outer coverings of the body portion and the lid, which, if a knife is inserted therethrough, will close the circuit to set off the igniters. Furthermore, the rim of the closure is provided with contact strips which, if shorted, will close the circuit to set off the thermite. Still another switch arrangement includes a mercury switch which, when tilted will close the circuitry to set off the thermite. Still another switch is included in the handle, the switch being normally closed but opened when the handle is grasped and will close if the grasp of the person carrying it is released. A switch is also disposed close to the handle for manual actuation in the event that the contents are threatened. Still another switch means is closed when the case is opened. The arming of the aforesaid switches are selectively controlled by the selectively positionable key operated lock switch.

This device can be utilized by banks, insurance companies, governmental agencies, international couriers and industrial companies having a need for transporting confidential information, secret formulae, etc. from one destination to another.

The most important feature of this invention is that, upon actuation, the destruction of the contents of the case is complete, thus, removing all worry and concern during the transportation of such material. A further advantage of this device is that, during the destruction of the contents of the carrying case there is no immediate appreciable outward signs or evidence of the destruction process taking place within.

Accordingly, it is an object of the present invention to provide a carrying case for protecting documents which case is inexpensive to manufacture, durable in structure, and efficient in operation.

Another object of the present invention is to provide a case for protecting papers which case will burn the papers, in the event that the case is tampered with.

Another object of the present invention is to provide a case for the protection of papers, the case burning the papers disposed within the case in the event that the case is armed and the case is removed from the hand of the carrier, or tampered with so as to open the case, or cut into with a knife, or prized opened.

Other objects features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figures 1, 2:
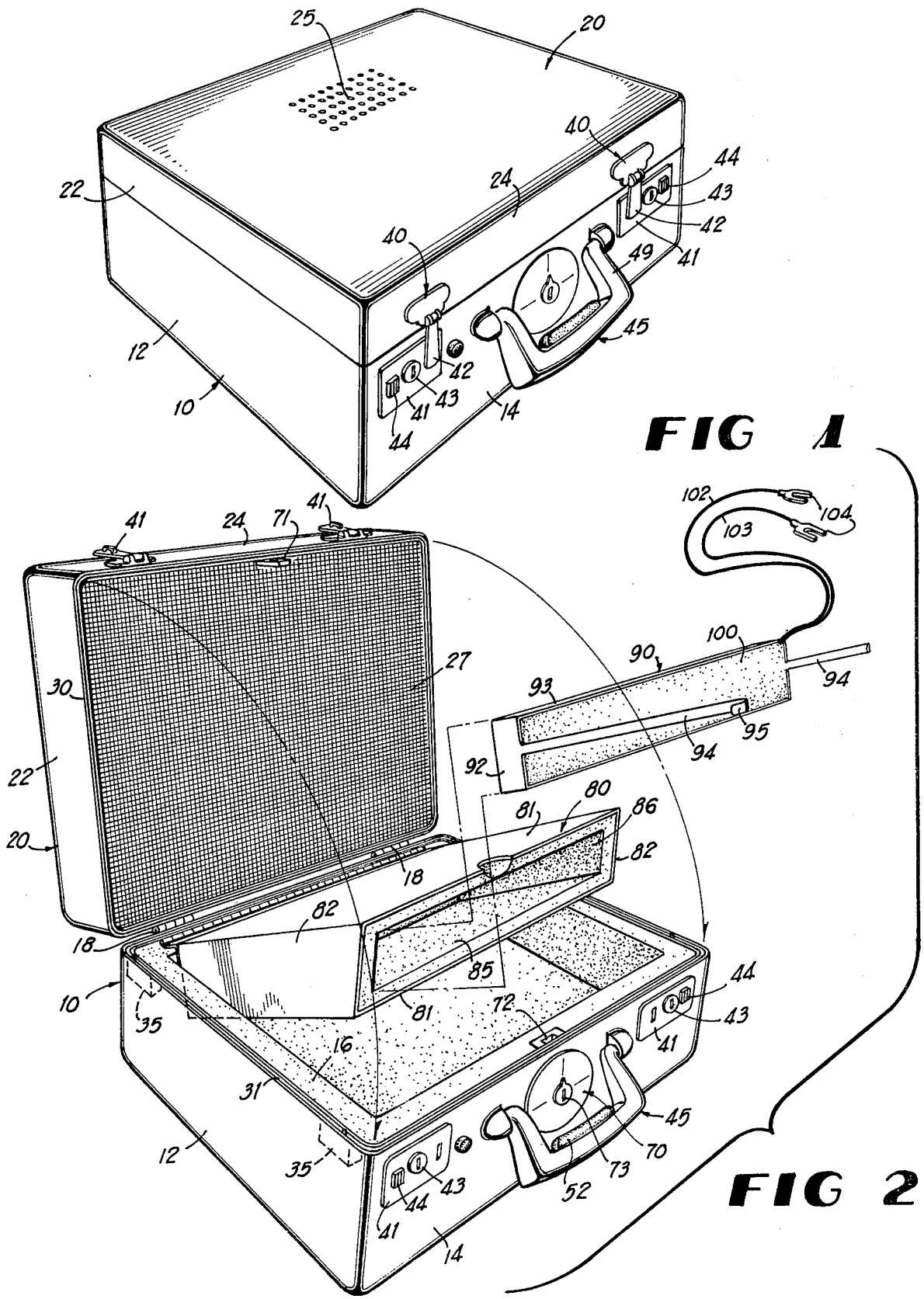
FIG. 1 is a perspective view of a protective carrying case constructed in accordance with the present invention.
FIG. 2 is an exploded view of the case of FIG. 1, the case being shown in an opened condition with the boat containing the pyrotechnic charge removed therefrom.
Figure 3:
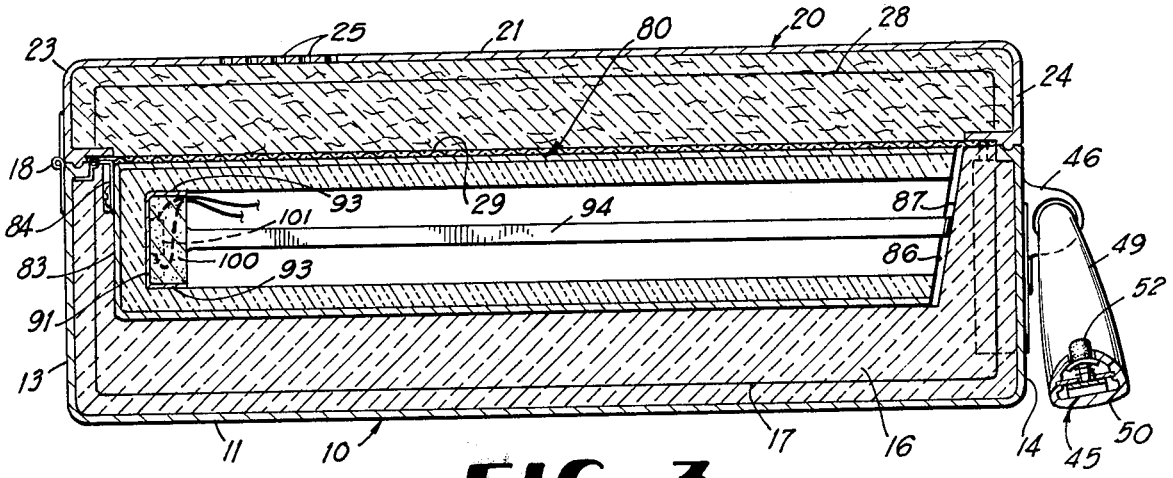
FIG. 3 is a vertical sectional view of the case shown in FIG. 1.

Referring now in detail to the embodiment chosen for the purpose of illustrating the present invention, numeral 10 in FIG. 1 denotes the lower body section of a closure, such as an attache or carrying case, valise or bag, this lower body section 10 having a bottom wall 11, side walls 12, a back wall 13 and a front wall 14.

The upper portion of the lower body portion or section 10 is open and the interior surface thereof is lined with sheets 16 of a refractory or insulation material such as ceramic fiber insulation or hot board. One suitable ceramic fiber insulation is known in the trade as "Fiberfrax" and is a product of the Insulation Division of Carborundum, P.O. Box 808, Niagara Falls, N.Y. 14302.

Embedded in this insulation material sheets 16 is a wire mesh panel or grid 17 which extends parallel to the inner surfaces of the bottom 11, side walls 12, back wall 13 and front wall 14. Grid 17 is metal and, therefore, electrically conducting and is spaced only slightly inwardly of the respective walls 11, 12, 13 and 14 so that, in the event that an electrically conducting knife is inserted through such wall and contacts the grid 17, an electrical circuit is made therebetween, for purposes to be described hereinafter.

Hingedly secured to the upper edge portion of the back wall 12 by means of hinges 18 is the lid or upper section 20 of the carrying case. This lid 20 includes a top wall 21, side walls 22, a back wall 23 and a front wall 24. The top 21 and the bottom 22 are both rectangular, being of the same dimensions, and the side walls 12 and 22 are in vertical alignment with each other. When the lid is closed, the back wall 13 and the back wall 23 are in vertical alignment in a common plane as is the front wall 14 and the front wall 24.

A portion of the top wall 21 is provided with a plurality of openings or gas exhaust holes 25 which are arranged in longitudinal and transverse rows, as best seen in FIG. 1. These holes or openings 25 communicate with the interior of the lid 20. Within this interior is a foraminous gas pervious ceramic fiber insulation or refractory member 26 which fills the entire interior of the lid 20, being retained in place by a flat rectangular screen 27 which is secured to a perimeteral inwardly turned flange 29 on the edges of the walls 22, 23 and 24. Preferably the member 26 is a felt material, known as "Fiberfrax H", also produced by the Insulation Division of Carborundum, which is quite porous so that gases may readily pass out of the interior of the case, passing first through the screen or retaining member 27 and thence through the felt member 26, and thereafter out of the holes or openings 25.

Embedded in the felt or insulating member 26, inwardly adjacent to and spaced from the walls 21, 22, 23 and 24 is a wire mesh panel or grid 28 which is electrically conducting so that if an electrically conducting knife (not shown) is inserted through any portion of the lid, it will engage this grid 28 and thereby create an electrical circuit between the lid 20 and this grid 28, for purposes to be described hereinafter.

Figure 5:
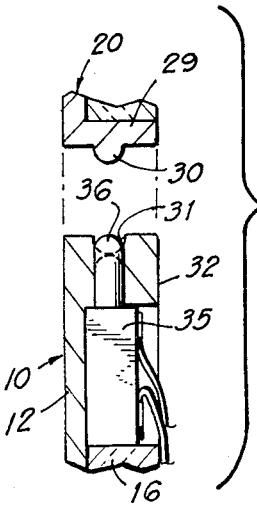
FIG. 5 is a fragmentary vertical sectional view of a detail showing the abutting rims of the case of FIG. 1 and one of the tamper switches which is actuated when the case is opened.

Along the lower periphery or lower edges of the walls 22, 23 and 24, i.e., along the inwardly turned flange 29 of the lid 20 is a perimeteral tongue or bead 30, best seen in FIG. 5. This tongue 30 is received in a complementary groove 31 in the upper perimeteral flange 32 along the upper edge of the lower body section 10. Recessed at the corner portions of the lower section 10, are respectively normally closed switches 35, the plungers 36 of which protrude upwardly and into the groove 31. Thus, when the lid 20 is closed on the body section 10, the tongue 30 will depress all four of the plungers 36 of the normally closed switches 35 so as to open each of these switches 35, for purposes to be described hereinafter. The switches 35 are respectively retained in place by the insulation material or sheets 16, as illustrated in FIG. 5.

For securing the lid 20 in a locked condition closed against the body portion 10 there are provided a pair of spaced fasteners, denoted generally by the numeral 40, the fasteners being preferably mounted on the front walls 14 and 24. In more detail, each fastener or fastening member 40 includes a pivoted latch 41 carried by the front wall 24 and a latch receiving member 42 carried by the front wall 14, the latch receiving member having a lock 43 and a release slide 44. The fastening member 40 is essentially conventional and hence a more detailed description is not required.

Disposed between the fastening member 40 on the front wall 14 is a handle assembly, denoted generally by numeral 45. This handle assembly 45 includes a pair of opposed journalling brackets 46 mounted on the front wall 14 and pivotally receiving a pair of spaced outwardly protruding hollow trunions 47 connected to the legs 49 of the handle assembly 45. These legs 49 protrude outwardly and are integrally connected at their outer ends by the handle 50 which extends transversely therebetween. The trunions 47, legs 48 and handle 49 are hollow and the lower or inner portion of the handle 50 is provided with an open slot 51 which receives therein a rigid switch depressing block 52. The inner edge or side of the depressing block 52 is carried by a arcuate plate 53 which is larger than the opening or slot 51 so as to limit the outward movement of the block 52 through the slot 51. Block 52 controls a normally closed handle switch 44 which includes plate 53. The plate 53 is provided with a pair of inwardly projecting pins 54 which are surrounded by a pair of helical springs 55. The pins 54 are made of a non-conducting material, such as plastic and protrude through a contact plate 57 secured within the hollow portion of the handle 50. A wire 58 is connected to the plate 57.

Figure 4:
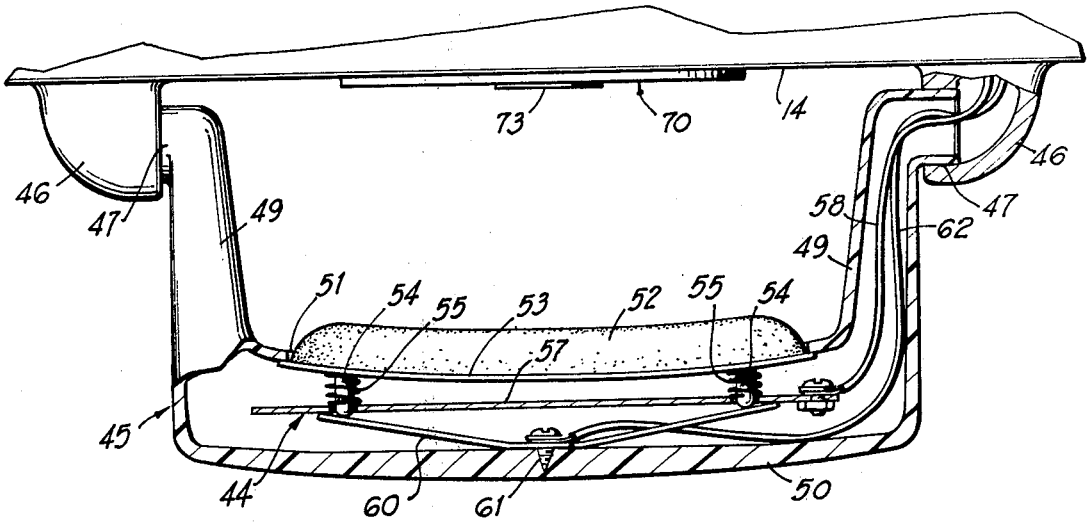
FIG. 4 is an enlarged partially broken away view of the handle of the case depicted in FIGS. 1, 2 and 3.

Outwardly of the fixed plate 57 is an electrically conducting contact blade 60, the ends of which are bent toward the plate 57 so as to normally be in contact therewith. The central portion of the blade 60 is secured by means of a screw 61 to the interior of the handle 50. The end portions of the blade 60 are respectively in contact with the ends of the pins 54. Thus, when the block 52 is in its normal position, it is urged by the springs 55 to its extended position as shown in FIG. 4; however, when the handle is grasped in a person's hand, the block 52 is urged inwardly, thereby moving the pins inwardly to flex the blade 60 and move the end portions thereof out of contact with the plate 57.

An electrical cable 62 is connected via the screw 61 to the blade 60. Thus, so long as the block 52 remains depressed, there is no electrical connection between the wire 62 and the wire 58; however, when the handle is released, the block 52 is urged outwardly so as to permit the ends of the blade 60 to contact the plate 57 to complete a circuit from wire 62 to wire 58. The wires 62 and 58 pass through the hollow portion of one leg 49 and thence through one of the trunions 47 and the brackets 46 and into the interior of the lower section 10 for purposes to be described hereinafter.

Between the brackets 46 is a key operated selector switch, denoted generally by the numeral 70. The selector switch 70 also functions as a lock which locks a hasp 71 on the lid 20 in a recessed position in a hasp receiving chamber 72. Such a lock, which includes the hasp 71 and the chamber 72, is conventional and need not be described in more detail except to state that when the lock 73 receives an appropriate key, not shown and is rotated, it will lock the hasp 71 in place so that the lid 20 cannot be opened until the key rotates the lock 73 to an unarmed position.

Within the interior of the attache case or carrying case 10 is the liner or document housing, denoted generally by the numeral 80. This housing 80 is formed of a tubular rectangular member, closed at its bottom and open at its top. This tubular member, therefore, has opposed parallel sides 81 and opposed parallel ends 82. It also has a closed bottom wall 83 which is hingedly secured by one edge, by means of a piano hinge 84, to the upper edge portion of the back wall 13.

The interior of the housing 80 is lined with a heat resistent refractory material 85 which can be identical to the insulation material 16. The outer open end 86 of the tubular housing or liner 80 is disposed at an angle so that when it is aligned and recessed within the interior of the body section 10, the open end is inclined downwardly and inwardly to conform to and be spaced from the downwardly and inclined front surface 87 of the front portion of insulation material 16. Thus, the liner 80 may be readily pivoted into and out of its recessed position in the body portion 10. When it is so recessed, the upper surface, that is one of the side walls 81 is essentially flush with the plane of the upper edge of the body portion 10.

When the lid 20 is closed on the body portion 10, the screen or grid 29 confines the liner 80.

As best visualized from FIG. 2, a boat or tray 90 is removably received within the bottom portion of the interior of the liner 80, the boat 90 having a bottom 91, sides 92 and ends 93. Thus, the boat 90 has an open side or top, opening into the interior of liner 80. A pair of straps 94 extend respectively from the ends 92 and are provided at their outer ends with outwardly turned hooks 95. The straps 94 are employed to insert the boat 90 into the interior of the liner 80 so that the hooks 95 loop over the outer end portions of the ends 82 of the liner 80. By such an arrangement, the boat 90 can be readily removed from the liner 80. According to the present invention, a non-explosive charge 100 of thermite (a combination of fine aluminum particles and iron oxide—$Fe_2O_3$), is placed in boat 93. This mixture or charge 100 will, when a small part of the charge is raised to a temperature above 1500° F., cause a chemical reaction to bring about an oxygen exchange from the iron oxide to the aluminum, resulting in iron and aluminum oxide. Once a small portion of this mixture is raised to this high temperature, the reaction rapidly progresses to the entire charge.

Since this reaction is exothermal, the temperature of the reactants rises to over 3000° F., which is more than high enough to char the contents of the liner 80 beyond recognition. The documents carried in the liner 80, being organic in nature and adjacent to charge 100, are thus totally destroyed due to the excessive heat generated by the reaction of the thermite charge 100 in the interior of liner 80. Burning is not an essential factor in the destruction since not enough oxygen is present within the case to support total destruction by burning.

Such high temperature is also capable of destroying models or components made of metals such as brass, cooper, bronze, aluminum, magnesium, pewter, or any pure or alloyed metal object whose melting point is below 3000° F. Thus, the term "secret documents" can also mean these models.

Figure 8:
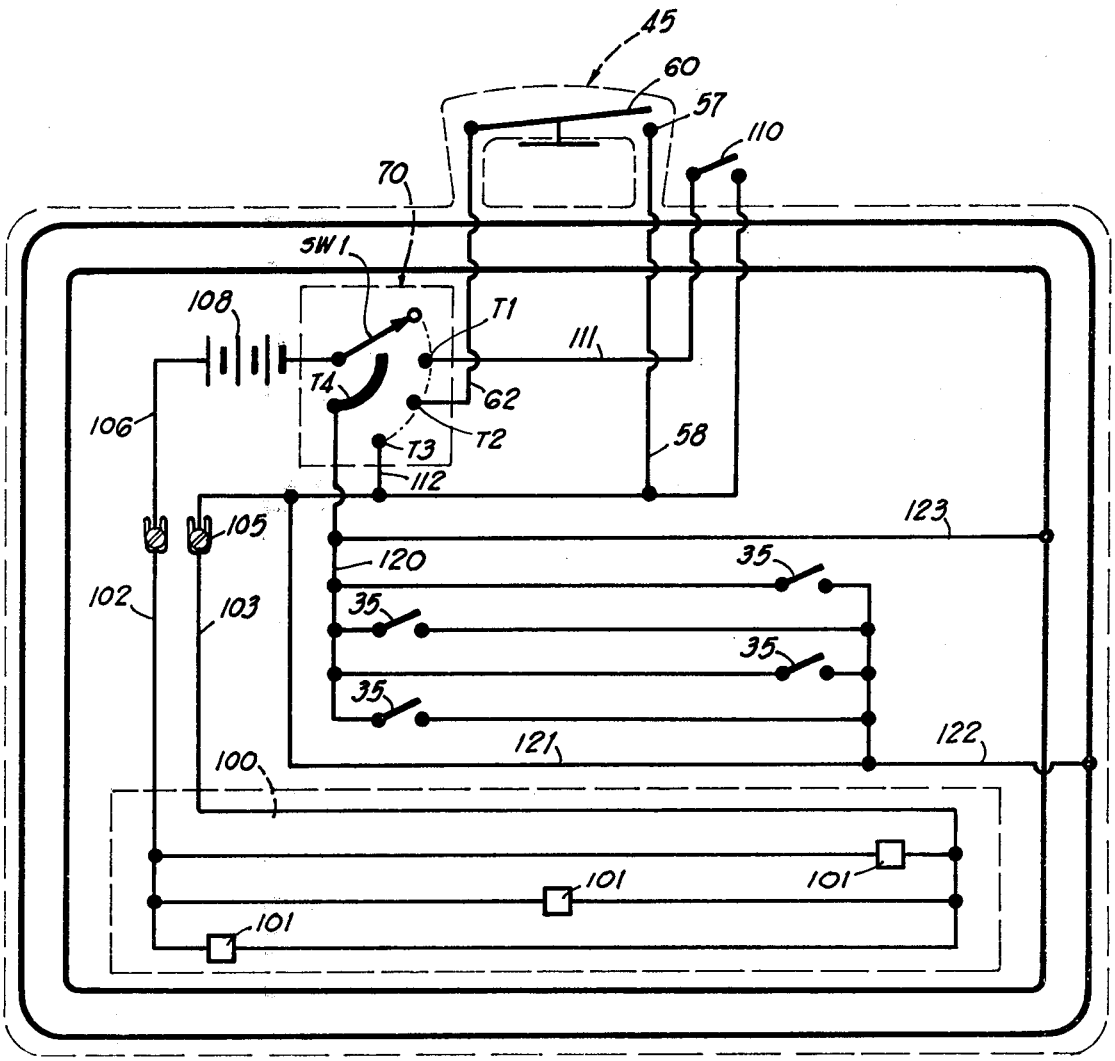
FIG. 8 is a schematic wiring diagram of the electrical circuitry of the case of FIG. 1.

Referring specifically to the drawings of FIG. 8, it is seen that the boat 90 is provided with three spaced squibbs or igniters 101 which are submerged in the thermite 100, these squibbs 101 providing sufficient heat when electrically actuated to set off the thermite 100. The squibbs 101 are electrically in parallel with each other being connected across a pair of wires 102 and 103 the ends of which are provided with electrical terminals 104, seen in FIG. 2.

These terminals 104 connect to screw terminals 105 on the interior of the body portion 10, the terminals 105 being respectively connected to wires 106 and 107. The wire 106, which is electrically connected to wire 102, leads to one terminal of battery 108. The other terminal of battery 108 is connected to the sweep arm of the main switch Sw1 which is part of the key operated selector switch 70. When the lock 73 is rotated, the sweep arm of switch Sw1 is rotated to any one of several positions. The sweep arm is illustrated in the off position in FIG. 8, and can be rotated to the T1, T2 or T3 position to contact terminals T1, T2 or T3, in addition to terminal T4.

Wire 107 is the bus which leads to the various switch means for actuating the pyrotechnic, via squibbs 101 and the thermite 100. The various switch means are actuated by a physical charge in the case.

Wire 107 leads to one teminal of a normally open, manually operated destruct button 110. The other terminal of switch 110 is connected via wire 111 to a first terminal T1. The button 110 is located in close proximity to the handle 45 so that it may be manually depressed, if desired.

The wire 107 is also connected to wire 58 and thence, as seen in FIG. 4, to plate 57. The switch blade 60 is connected via wire 62 to terminal T2 of switch Sw1. The wire 107 is also connected to terminal T3 via wire 112.

The switch Sw1 has a wiper contact terminal T4 which covers an arc of approximately 90°, being connected via wire 120 to the normally closed, improper entry destruct switches 35. The other terminals of these switches 35 are connected to wire 107 via wire 121. The switches 35 are all in parallel between wires 120 and wire 121. The wire 121 is connected to the metal case or outer body which includes the walls 11, 12, 13, 14, 21, 22, 23, and 24 via a wire 122. The grids 17 and 28 are connected via wire 123 to wire 120. Therefore, the making of a circuit between the case and the grid 17 or 28 will complete a circuit between wires 122 and 123.

The switch Sw1, when turned to its first position contacts the terminals T1 and T4 so as to arm the destruct button 110 and also arm the improper entry switches 35 as well as the grids 17 and 28. In such a position, if the knife is inserted into the case, so as to close the circuit between the grid 17 and 28 and the case, the squibbs 101 will be ignited. In similar fashion, if any one of the switches 35 which are held open when the case is closed, is itself closed, by the opening of the case, the squibbs 101 will be ignited.

If the switch Sw1 is turned to its second position, the terminal T2 and the terminal T4 are contacted and the dead man's handle or switch 44 is armed so that if the handle 45 is released, the switch 44 will be closed to ignite the squibbs 101. Also, in this position of switch Sw1, the elements connected to switch T4 are also armed.

When the switch Sw1 is rotated to contact the terminal T3, both the deadman switch 44, and the destruct button switch 110 are armed so that either switch when closed will set off the squibbs 101. Furthermore, the T4 contact is also made so that the switches 35 are armed.

Figure 7:
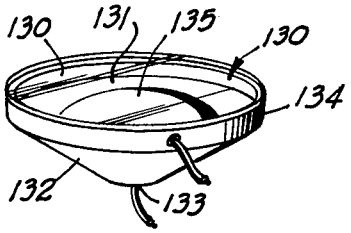
FIG. 7 is a view of a detail showing the tilt switch incorporated in the case depicted in FIG. 1.

As seen in FIG. 7, the case may be provided, if desired, with a tamper switch 130 in the form of a gravity switch. This gravity switch 130 would be actuated when the case is moved so as to tilt switch 130 from a prescribed vertical or a prescribed horizontal position. The switch 130 may, if desired, be substituted for any one of the switches, such as the switch 44 or switches 35. It may, also, be placed in parallel with these switches 35 or 44. In more detail, the gravity switch 130 includes a closed housing provided with a flat top 131 and a cone shaped bottom 132 joined together to enclose the mercury 135. The gravity switch 130 is embedded in the insulating material 16 so that it is disposed horizontally, as shown in FIG. 7, when the case is in a flat horizontal condition and is disposed vertically thereto when the case is upright. The bottom portion at the apex of the cone shaped bottom 132 is provided with an electrical contact terminal 133 while the upper portion or upper end of the cone shaped base 132 is provided with an electrically conducting ring or annular member 134.

The mercury 135 is disposed within the case so that it normally is contacting only the terminal 133 when the case is disposed horizontally, but will contact the ring 134 when the case is tilted from the horizontal position. When, however, the case is in the vertical position, the mercury 135 contacts only the ring 134. Any appreciable movement from the vertical then will cause the mercury 135 to contact both terminals 133 and 134.

Figure 6:
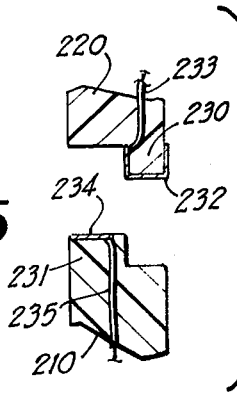
FIG. 6 is a fragmentary vertical sectional view, similar to FIG. 5, but showing another portion of the abutting rims of the case depicted in FIG. 1.

In FIG. 6, it is seen that, if desired, a case may be made of non conducting material, the case including a lower section or body 210 and an upper section or lid 220. The upper section has an overhanging ledge 230 which, when the case is closed, overlies an inner ledge 231. The ledge 230 extends around the entire perimeter of the lid 220 and the ledge 231 extends around the entire perimeter of the body 210. A U-shaped cover 232 of conducting material is connected to an electrical cable 233 which is embedded in the lid 220. The shoulder 231 is provided with an electrical contact plate 234 along its upper surface and it is electrically connected to a cable 235. The cables 235 are in parallel with the previously described switches so that when the case is closed and, in the event that a knife is inserted to prize open the case, the knife will make electrical contact between the cover 232 and the plate 234 so as to actuate through the electrical circuit, the squibbs 101.

It will be obvious to those skilled in the art that many variations may be made in the embodiments here chosen for the purpose of illustrating the present invention without departing from the scope thereof as defined by the appended claims.

What is claimed is:

1. A case for the protection of secret documents comprising:

(a) a closure having opposed body portions defining an interior and an access opening for access into said interior, said closure being provided with a hole communicating with the interior and through which gases may readily escape when said closure is closed;

(b) a liner disposed within the interior of said closure, said liner having, itself, an open interior and an access opening communicating with said open interior, through which documents may be inserted and removed from said open interior, said open interior of said liner and said interior of said closure communicating so that gases from said interior of said liner may pass through said interior of said closure and out of said hole;

(c) a pyrotechnic charge within said liner;

(d) switch means on said closure actuatable upon a change in the physical condition of said closure;

(e) igniter means in close proximity to said pyrotechnic charge and electrically connected to said switch means for igniting said pyrotechnic charge when said igniter means is actuated;

(f) a source of current carried by said closure and electrically connected to said switch means and to said igniter means for actuating said igniter means when said switch means is actuated; and (g) control means for said switch means for rendering said switch means actuateable or nonactuatable.

2. The case defined in claim 1 wherein said closure is a metal container and wherein said liner includes a heat insulating material for surrounding the secret documents therein.

3. The container defined in claim 1 wherein said pyrotechnic charge is thermite.

4. The case defined in claim 1 wherein said switch means includes a switch disposed adjacent to the access opening of said closure and actuatable when said closure is opened.

5. The case defined in claim 1 including a handle mounted on said closure, a switch disposed within said handle and means on said handle for opening said switch when said handle is grasped by a person.

6. The case defined in claim 1 including a handle on said closure and switch means disposed adjacent to said handle for actuation manually.

7. The case defined in claim 5 wherein said closure is electrically conducting and wherein said switch means includes a grid disposed within the interior of said closure for making an electrical circuit with said closure when an electrical conducting object engages said closure and said grid simultaneously.

8. The case defined in claim 1 wherein said control means is a lock switch which can be locked in a closed position or in an open position, said switch being in series with said switch means when in its closed position.

9. The case defined in claim 7 wherein said switch means includes a plurality of switches disposed adjacent to the access opening of said case for actuation when said case is opened and including additional switch means disposed adjacent to said handle, said additional switch means and said switches being respectively actuatable for actuating said igniter means.

10. The case defined in claim 1 wherein said igniter means are a plurality of squibbs disposed in spaced relationship adjacent to said pyrotechnic charge.

11. The apparatus defined in claim 1 including a removable boat carried by said liner and carrying said pyrotechnic charge and said igniter means, said boat being removable from said liner.

12. The case defined in claim 10 wherein said boat is a rectangular member open along one side thereof and removably received within the bottom portion of said liner, a pair of opposed straps extending from said boat along the interior of said liner and terminating exteriorally of said liner by means of which said boat may be removed from and inserted into said liner.

13. The case defined in claim 1 wherein said closure includes a body section and a lid, first hinge means joining an edge portion of said body section and an edge portion of said lid, and second hinge means joining said liner to said body section.

14. The case defined in claim 1 wherein said closure is provided with insulating material, a portion of said insulating material adjacent to said hole being foraminous and through which gases may pass from the interior of said closure to said hole.

15. The case defined in claim 1 wherein said switch means includes a switch carried by said closure, said switch being normally open when said closure is resting upon a flat surface but being closed when said closure is tilted from its position of resting on said flat surface.

16. The case defined in claim 15 wherein said switch is a mercury switch.

17. The case defined in claim 16 wherein said mercury switch is electrically open when said case is resting in a horizontal position but is closed when said case is moved appreciably from either of the aforesaid positions.

18. The case defined in claim 1 wherein said switch means includes a pair of spaced electrically conducting strips disposed adjacent to each other along the access opening of said closure, said strips being in close proximity to each other for closing when an electrical conducting object is inserted into said access opening and contacts both of said strips.

* * * * *